US008270655B2

(12) United States Patent
Ito et al.

(10) Patent No.: US 8,270,655 B2
(45) Date of Patent: Sep. 18, 2012

(54) HEADPHONE DEVICE

(75) Inventors: Tomohiro Ito, Tokyo (JP); Yasuo Yuyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 859 days.

(21) Appl. No.: 12/194,406

(22) Filed: Aug. 19, 2008

(65) Prior Publication Data

US 2009/0052718 A1 Feb. 26, 2009

(30) Foreign Application Priority Data

Aug. 24, 2007 (JP) ..... P2007-219089

(51) Int. Cl.
*H04R 1/10* (2006.01)

(52) U.S. Cl. ..... 381/380; 381/309

(58) Field of Classification Search ..... 381/380, 381/309

See application file for complete search history.

(56) References Cited

U.S. PATENT DOCUMENTS

| | | | | |
|---|---|---|---|---|
| 5,034,995 | A * | 7/1991 | Ciccone | 455/344 |
| 6,466,681 | B1 * | 10/2002 | Siska et al. | 381/372 |
| 7,348,490 | B2 * | 3/2008 | Sakai | 174/113 R |
| 2005/0036643 | A1 | 2/2005 | Le Gette et al. | |
| 2007/0003093 | A1 | 1/2007 | Ito et al. | |
| 2007/0080186 | A1 | 4/2007 | deLeon et al. | |
| 2007/0160249 | A1 | 7/2007 | Le Gette et al. | |

FOREIGN PATENT DOCUMENTS

| | | | |
|---|---|---|---|
| JP | 52-170029 | | 12/1977 |
| JP | 7-42297 | | 7/1995 |
| JP | 7-327292 | * | 12/1995 |
| JP | 11-298982 | | 10/1999 |
| JP | 2000-23278 | | 1/2000 |
| JP | 3108997 | | 9/2000 |
| JP | 2005-217464 | | 8/2005 |
| JP | 2006-109511 | | 4/2006 |
| WO | WO 03/103255 | | 12/2003 |
| WO | WO 2007/039281 | | 4/2007 |

OTHER PUBLICATIONS

Japanese Patent Application No. 2007-219089. Office Action issued on Dec. 24, 2009.

* cited by examiner

*Primary Examiner* — A. Sefer
(74) *Attorney, Agent, or Firm* — Finnegan, Henderson, Farabow, Garrett & Dunner, L.L.P.

(57) ABSTRACT

A headphone device includes a pair of headphone units composed of a left headphone unit and a right headphone unit, a band section that is attached to the left headphone unit and the right headphone unit, and arranged so as to be positioned at the back of a head, a headphone cord attached to the left headphone unit or the right headphone unit, and a headphone cord attaching section that freely changes a branch point of the band section and the headphone cord by moving along the band section in a freely sliding manner in order to place the headphone cord along the band section to integrate the headphone cord and the band section with each other.

3 Claims, 5 Drawing Sheets

HEADPHONE DEVICE

CROSS REFERENCE TO RELATED APPLICATIONS

The present invention contains subject matter related to Japanese Patent Application JP 2007-219089 filed in the Japanese Patent Office on Aug. 24, 2007, the entire contents of which being incorporated herein by reference.

BACKGROUND OF THE INVENTION

1. Field of the Invention

The present invention relates to a headphone device, and is suitably applied to a headphone device that is used by being connected to, for example, a portable music player.

2. Description of the Related Art

As an age of individualization centering on young people progresses, a request for listening to music whenever and wherever the user desires has become stronger. Under the circumstances, a stereo headphone of a wearing system in which a band is arranged at the back of the user's head is gradually accepted by a wide range of people who care about hairstyles and fashion (for example, refer to Jpn. Pat. Appln. Laid-Open Publication Nos. 2006-109511 arid H11-298982).

For example, as shown in FIG. 1, a stereo headphone (hereinafter referred to as rear band type stereo headphone) 1 of a conventional system of wearing in which a band is positioned at the back of the head generally includes a headphone cord 2 that extends from a housing 4 of a left headphone unit 3, as shown in FIGS. 2A and 2B.

This is because the rear band type stereo headphone 1 is designed based on consideration that the headphone cord 2 extending from the housing 4 of the left headphone unit 3 does not usually become an interference in a situation where people are generally considered to be right-handed.

SUMMARY OF THE INVENTION

With respect to the rear band type stereo headphone 1 having the above structure, in case the user uses the rear band type stereo headphone 1 in diversified listening environments for a long period of time, such as listening during exercise of jogging and the like, the headphone cord 2 extending from the housing 4 of the left headphone unit 3 may become an interference. Accordingly, there has been a problem that the rear band type stereo headphone 1 is not necessarily excellent in usability.

The present invention has been made in consideration of the above points, and proposes a user-friendly headphone device that has a headphone cord which does not become an interference when the headphone is worn, arid is excellent in a feeling of wearing.

According to an aspect of the present invention, it is desirable to be provided a pair of headphone units, a band section, a headphone cord, and a headphone cord attaching section. The pair of headphone units includes a left headphone unit and a right headphone unit. The band section is attached to the left headphone unit and the right headphone unit, and arranged so as to be positioned at the back of a head. The headphone cord is attached to the left headphone unit or the right headphone unit. The headphone cord attaching section freely changes a branch point of the band section and the headphone cord by moving along the band section in a freely sliding manner in order to place the headphone cord along the band section to integrate the headphone cord and the band section with each other.

In the above manner, the band section and the headphone cord can be branched at an arbitrary branch point while integrating the band section and the headphone cord with each other. Accordingly, a problem that the headphone cord becomes interference for the user wearing the headphone can be resolved.

According to the present invention, the band section and the headphone cord can be branched at an arbitrary branch point while integrating the band section and the headphone cord with each other. Accordingly, a problem that the headphone cord becomes an interference for the user wearing the headphone can be resolved. Therefore, a user-friendly headphone device excellent in a feeling of wearing with a headphone cord that does not become an interference when the headphone is worn can be realized.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Hereinafter, an embodiment of the present invention will be described in detail with respect to the accompanying drawings.

Figure 1:
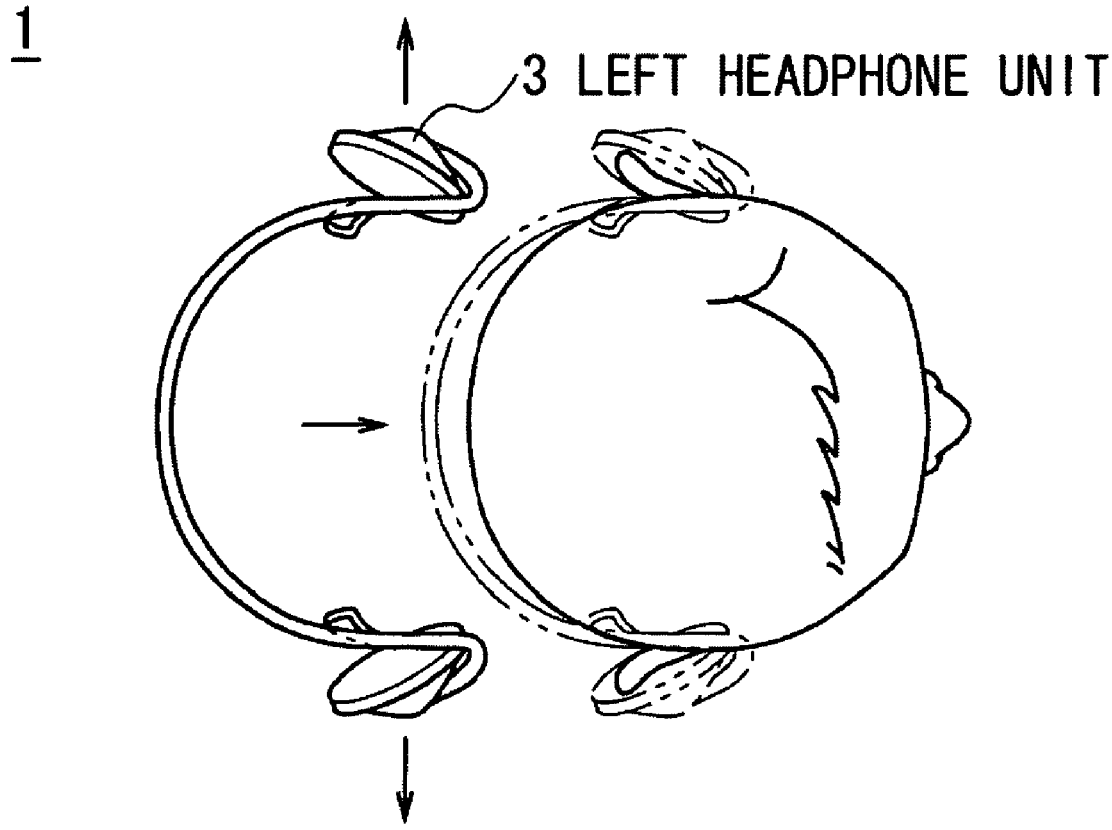
FIG.1 (RELATED ART)
FIG. 1 is a top view showing a structure of a conventional rear band type stereo headphone (1)
Figure 2B:
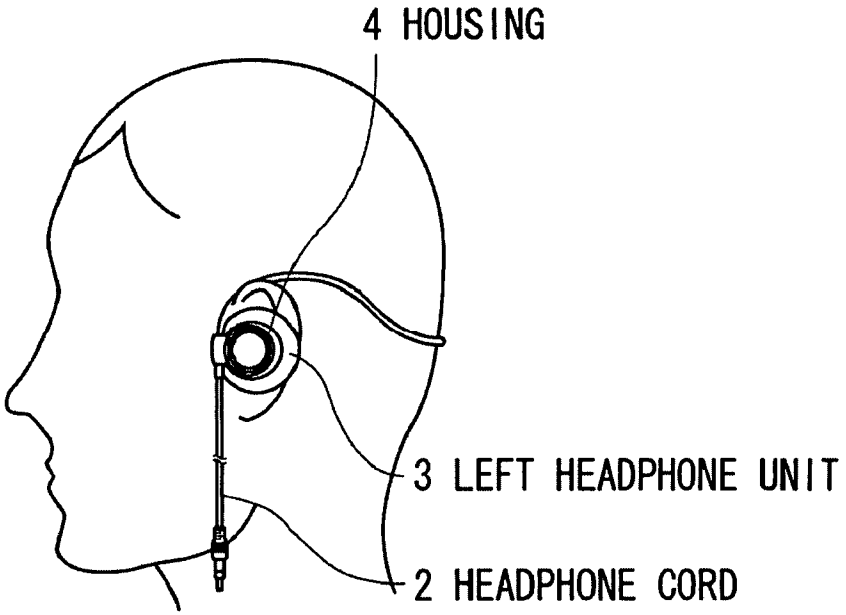
FIG.2B (RELATED ART)
FIGS. 2A and 2B are a front view and a left side view showing a structure of a conventional rear band type stereo headphone (2)
Figure 2A:
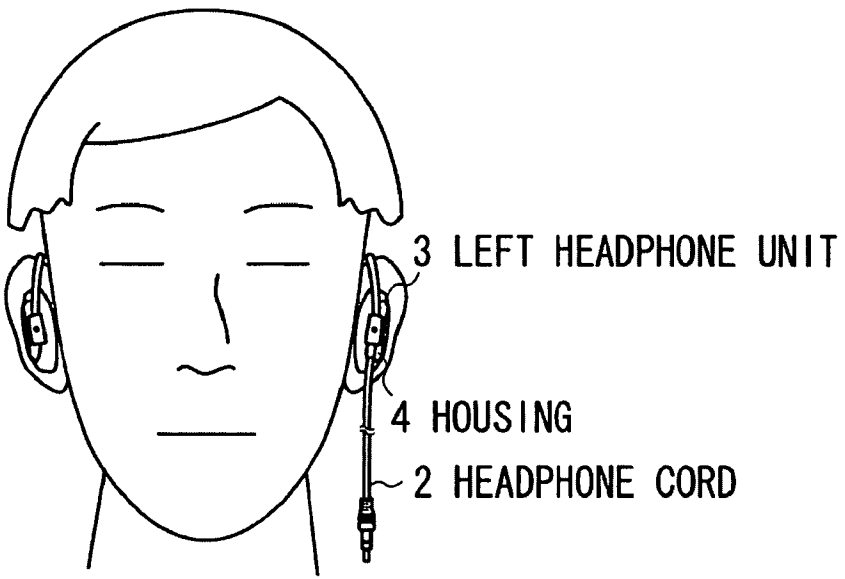
FIG.2A (RELATED ART)
Figure 3:
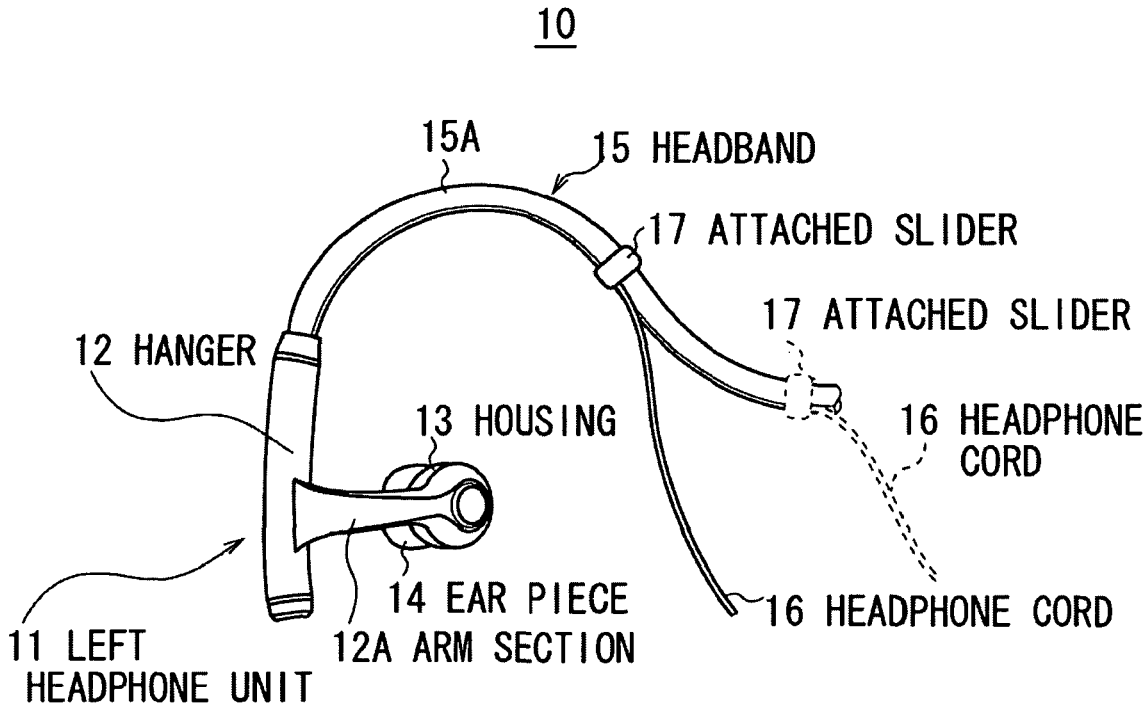
FIG. 3 is a schematic perspective view showing a structure of a rear band type stereo headphone of the present invention.

(1) Entire Configuration of Rear Band Type Stereo Headphone According to an Embodiment of the Present Invention FIG. 3 shows an entire rear band type stereo headphone 10 in the present invention. FIG. 3 only discloses a left side of the stereo headphone 10, and a right side thereof is omitted.

The rear band type stereo headphone 10 includes a left headphone unit 11 and a headband 15 attached to the left headphone unit 11.

The left headphone unit 11 has a hanger 12 having a substantially cylindrical shape. A headband 15 is attached to the hanger 12. The headband 15 is curved so that the headband 15 can be hooked on an ear capsule (not shown) of the user and is fitted along the back of the head.

The hanger 12 is provided with an arm section 12A at a predetermined position in a lower section thereof in an integral state. The arm section 12A has a predetermined length and projects into a direction toward an ear capsule from the hanger 12. When the rear band type stereo headphone 10 is worn, the hanger 12 is positioned in front of an ear capsule in an upright state.

In addition, the hanger 12 has a housing 13 attached to an end of the arm section 12A. An ear piece 14 at a section inserted into an external acoustic meatus is attached to the hanger 12 in a state where a driver unit (not shown) is included in the housing 13.

At this time, the hanger 12 has an ear-hook section 15A of the headband 15 attached to a top end of the hanger 12. The ear-hook section 15A is curved to have a moderate curved shape along a shape of an upper section of an ear capsule.

The hanger 12 itself is not hooked on an ear capsule of the user. Instead, the hanger 12 holds the ear-hook section 15A of the headband 15 in a state where the ear piece 14 is inserted into an external acoustic meatus of the user.

The headband 15 is held in a state where the ear-hook section 15A having a substantial arc shape is hooked on an ear capsule, and at the same time, a remaining section of the headband 15 is fitted along the back of the head. A wire (not shown) that is curved to have a shape of the ear-hook section 15A and a shape along the back of the head of the user is threaded through the inside of the headband 15. In this manner, consideration is made with respect to a point that a shape of the headband 15 does not change easily when the headphone is worn.

The headband 15 uses an elastic body made of synthetic resin, such as polypropylene (PP) and polybutylene terephthalate (PBP), as a material for an outer surface thereof.

In addition, the rear band type stereo headphone 10 includes a headphone cord 16 connected to the driver unit in the housing 13. The headphone cord 16 extends to the outside from the hanger 12 side by side with the headband 15.

The rear band type stereo headphone 10 includes an attached slider 17 having an annular shape used to put together the headband 15 and the headphone cord 16 into an integral state. The attached slider 17 can move on the headband 15 freely in a sliding manner.

The attached slider 17 has a diameter that is almost equal to or slightly smaller than that of the headband. Since an elastic body made of synthetic resin, such as polypropylene (PP) and polybutylene terephthalate (PBP), is used as a material of the attached slider 17, the attached slider 17 can softly tighten the headband 15 and the headphone cord 16 in an integral manner.

Figure 4:
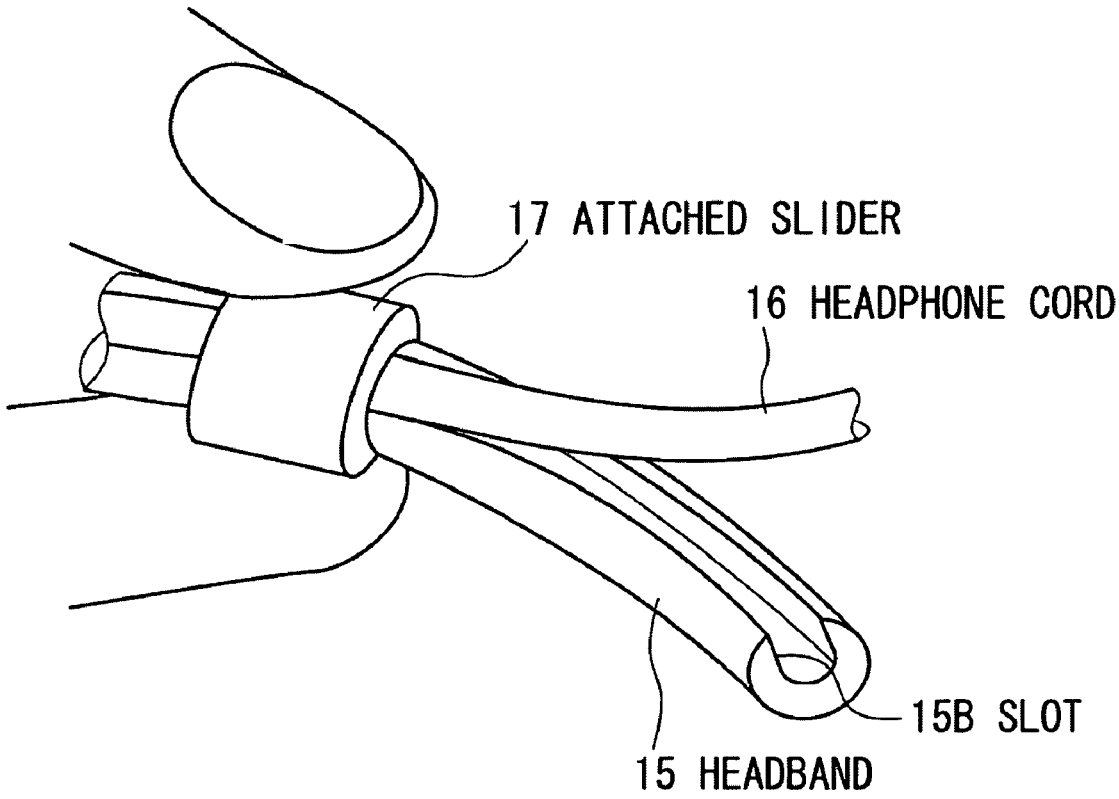
FIG. 4 is a schematic view showing a state in which a headphone cord is fitted into a slot of a headband.

Here, as shown in FIG. 4, undercut slot 15B having a diameter substantially equal to that of the headphone cord 16 is formed on the headband 15. When the attached slider 17 slides on the headphone cord 16, the headphone cord 16 is fitted into the slot 15B.

When the headphone cord 16 is fitted into the slot 15B of the headband 15, the headphone cord 16 is almost entirely embedded into the headband 15 except for a surface of the headphone cord 16 slightly projecting to the outside.

For the above reason, the headphone cord 16 and the headband 15 can be integrated with each other, and at the same time, the headphone cord 16 is embedded in the headband 15. Accordingly, there seemingly exists only the headband 15.

As shown in FIG. 3, the rear band type stereo headphone 10 includes the headband 15 and the headphone cord 16 in an integral state within a range from the hanger 12 to the attached slider 17. From the attached slider 17 as a boundary, the headband 15 and the headphone cord 16 are in a branch state.

That is, as shown by a solid line and a broken line in FIG. 3, in the rear band type stereo headphone 10, the user can freely adjust a branch point of the headband 15 and the headphone cord 16 by moving a position of the attached slider 17 in an arbitrary manner.

(2) Structure of Hanger

Figure 5:
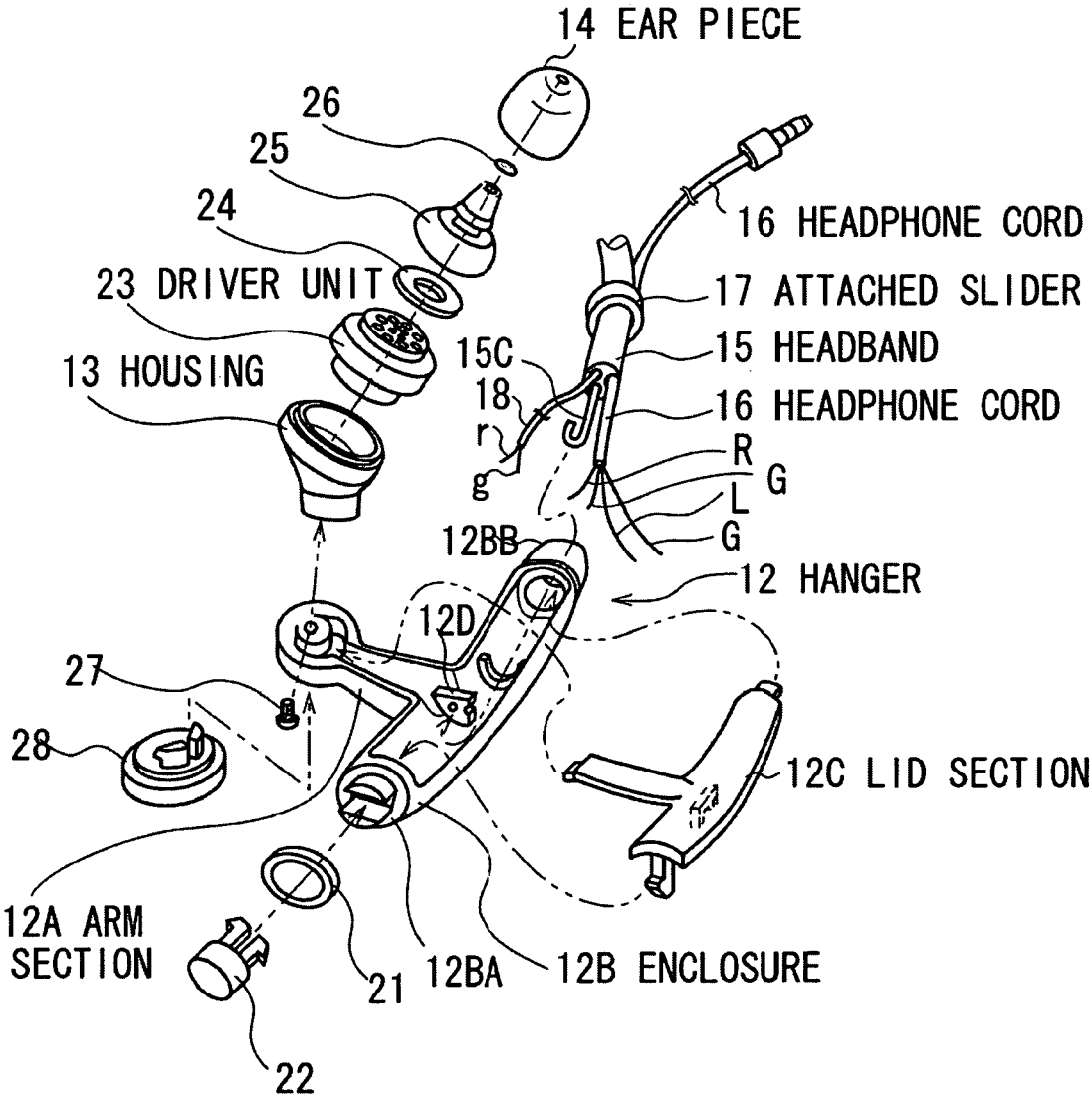
FIG. 5 is a schematic perspective view showing a structure of a hanger.

As shown in FIG. 5, the hanger 12 can be integrated with the arm section 12A in a manner that lid section 12C that has a substantial T-shape and is little smaller than an enclosure 12B having a similar substantial T-shape is fitted in the enclosure 12B by using a claw section.

The hanger 12 has an end cap 22 that is attached to a lower end section 12BA of an enclosure 12B with a cosmetic ring of an orange color interposed therebetween.

In addition, the hanger 12 has the housing 13 attached to an end of the arm section 12A by using a screw 27. A driver unit 23 is included in the housing 13. At the same time, an ear piece 14 is attached to the driver unit 23 with a resister 24, a front housing 25, and an equalizer 26 for adjusting a frequency characteristic interposed therebetween.

Further, the hanger 12 includes a cosmetic cap 28 attached to an end of the arm section 12A in a direction opposite to the housing 13 in a fitting mechanism. In this manner, the appearance of the hanger 12 is enhanced.

The hanger 12 has the headband 15 and the headphone cord 16 threaded through a through hole of an upper end section 12BB of the enclosure 12B. A wire 15C included in the headband 15 engages with an engagement section 12D of the enclosure 12B so that the headband 15 is attached to the enclosure 12B.

As described above, the wire 15C is threaded through the inside of the headband 15 in a state where the wire 15 is curved to have a shape of the ear-hook section 15A and a shape along the back of the head of the user. The wire 15C prevents a shape of the headband 15 from changing easily when the headphone is worn, in a state where the ear-hook section 15A of a substantial arc shape is naturally hooked on an ear capsule and a remaining section of the headband 15 is fitted along the back of the head at the same time.

At this time, a core wire L for a left channel and a ground wire G in the headphone cord 16 pass through the enclosure 12B and the arm section 12A and are connected to the driver unit 23.

In addition, a core wire R for a right channel and the ground wire G in the headphone cord 16 are bent in the inside of the enclosure 12B. Then, the core wire R and the ground wire G are connected to a core wire r for the right channel and a ground line g in a connecting wire 18 used for connecting with a driver unit (not shown) for the right channel.

That is, the headphone cord 16 has the connecting wire 18 including the core wire r for the right channel and the ground wire g threaded through the inside of the headphone cord 16. Accordingly, an audio signal for the right channel that is supplied through the headphone cord 16 can ensure to be supplied to the driver unit (not shown) for the right channel by the connecting wire 18, when the attached slider 17 changes the branch point between the headband 15 and the headphone cord 16 to any position.

(3) Operation and Advantageous Effect

In the configuration described above, the rear band type stereo headphone 10 does not have the structure where the headphone cord 16 extends from the housing 13 of the left headphone unit 11. Instead, the rear band type stereo headphone 10 adopts the structure where the headphone cord 16 extends from the upper end section 12BB of the enclosure 12B in the hanger 12 in an upward direction together with the headband 15. In this manner, the user does not feel troublesomeness due to the headphone cord 16 hitting a cheek of the user and the like from the beginning.

In addition, the rear band type stereo headphone 10 includes the headband 15 and the headphone cord 16 which are independent from each other and integrated with each other by using the attached slider 17 in a state where the headband 15 and the headphone cord 16 are side by side.

Also, the headband 15 and the headphone cord 16 are branched at a position of the attached slider 17 as the branch point.

Therefore, the rear band type stereo headphone 10 can have a structure where the headphone cord 16 seemingly extends from the position of the attached slider 17. Also, the branch point can be freely changed by moving the attached slider 17.

In this manner, the rear band type stereo headphone 10 can freely adjust a position where the headphone cord 16 extends from the headband 15 by using the attached slider 17, so as to prevent the headphone cord 16 from becoming an interference depending on a listening environment and a listening situation of the user.

In particular, the rear band type stereo headphone 10 can move the attached slider 17 to the backside of the head, so that the headphone cord 16 can extend from a position just behind the back of the head instead of the back of an ear capsule. In this manner, the existence of the headphone cord 16 can be erased from awareness of the user.

Further, the rear band type stereo headphone 10 includes the wire 15C that is curved in advance to have a shape of the ear-hook section 15A and a shape along the back of the head of the user, and threaded through the inside of the headband 15 having elasticity. Therefore, a wearing state in which the ear-hook section 15A is hooked on an ear capsule and a remaining section is fitted along the back of the head can be naturally maintained. Accordingly, a feeling of lightweight and a feeling of wearing that is excellent and stable in comparison with a metallic headband can be provided.

According to the configuration described above, the rear band type stereo headphone 10 includes the headband 15 and the headphone cord 16 that are made integrated with each other in a side-by-side state by the attached slider 17. Also, by moving a position of the attached slider 17, the branch point of the headband 15 and the headphone cord 16 can be adjusted arbitrarily.

In the above manner, the rear band type stereo headphone 10 can have the headphone cord 16 extending from a position of the attached slider 17 that is desired by the user. Accordingly, the headphone cord 16 does not become interference for the user, and operability and a feeling of wearing can be significantly improved.

(4) Other Embodiments

In the embodiment described above, the description has been made with respect to the case where the slot 15B for fitting the headphone cord 16 in the headband 15 is provided. However, the present invention is not limited thereto, and the slot 15B is not necessarily provided.

In addition, in the embodiment described above, the description has been made with respect to the case where the headphone cord 16 is connected to the left headphone unit 11. However, the present invention is not limited thereto, and the headphone cord 16 may be connected to a right headphone unit to have a structure that is completely reverse to the present embodiment.

Further, in the embodiment described above, the description has been made with respect to the case where the headphone cord 16 is made integrated with the headband 15 positioned at the back of the head by using the attached slider 17 arid the branch point is adjusted freely. However, the present invention is not limited thereto, and the headphone cord 16 may be made integrated with a headband positioned above the head of the user or a headband positioned below a jaw of the user by using the attached slider 17, and the branch point is adjusted freely.

Further, in the embodiments described above, the description has been made with respect to the case where an elastic body made of synthetic resin, such as polypropylene (PP) and polybutylene terephthalate (PBP), is used as a material for an outer surface of the ear-hook hanger 15. However, the present invention is not limited thereto, and the ear-hook hanger 15 is not necessarily be formed by an elastic body made of synthetic resin, but may as well be formed by using a metallic material having corrosion resistance and a metallic material having elasticity.

Further, in the embodiment described above, the description has been made with respect to the case where the wire 15C is threaded through the inside of the headband 15 to maintain a shape of the ear-hook section 15A and a shape along the back of the head of the user, so that the shape of the headband 15 is prevented from easily changing when the headphone is worn in a state where the ear-hook section 15A having a substantial arc shape is naturally hooked on an ear capsule and a remaining part of the headband 15 is fitted along the back of the head. However, the present invention is not limited thereto, and the headband 15A may be formed by a resin that is bent in advance in a shape of the ear-hook section 15A and a shape along the back of the head of the user, without using the wire 15C.

Further, in the embodiment described above, the description has been made with respect to the case where the headphone device according to the embodiment of the present invention includes the left headphone unit 11 as a headphone unit, the headphone cord 16 as a headphone cord, and the attached slider 17 as a headphone cord attaching section. However, the present invention is not limited thereto, and the headphone device of the present invention may include a headphone unit, a band section, a headphone cord, and a headphone cord attaching section having other various structures.

The headphone device of the present invention can be applied to a headphone device that is used by being connected to, for example, a portable phone, a personal digital assistant (PDA), a notebook type personal computer, and other various types of electronic equipment, in addition to a portable type music player.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone device, comprising:

a pair of headphone units composed of a left headphone unit and a right headphone unit;

a band section that is attached to the left headphone unit and the right headphone unit, and arranged so as to be positioned at the back of a head;

a headphone cord attached to the left headphone unit or the right headphone unit; and a headphone cord attaching section that freely changes a branch point of the band section and the headphone cord by moving along the band section in a freely sliding manner, wherein the band section is provided with a slot along an entire length thereof, the headphone cord being fitted into the slot of the band section for integrating the band section and the headphone cord.

2. The headphone device according to claim 1, wherein the headphone cord attaching section integrates the headphone cord and the band section by fitting the headphone cord into the slot of the band section as the headphone cord attaching section moves along the band section in a freely sliding manner.

3. The headphone device according to claim 1, wherein the headphone cord attaching section is made of an elastic body of a substantial cylindrical shape, and integrates the headphone cord and the band section by placing the headphone cord along the band section in a state of wrapping the headphone cord and the band section.

* * * * *